United States Patent [19]

El-Sayed

[11] Patent Number: 4,820,605

[45] Date of Patent: Apr. 11, 1989

[54] MODIFIED LIQUID ELECTROSTATIC DEVELOPER HAVING IMPROVED IMAGE SCRATCH RESISTANCE

[75] Inventor: Lyla M. El-Sayed, West Chester, Pa.

[73] Assignee: E. I. Du Pont de Nemours and Company, Wilmington, Del.

[21] Appl. No.: 125,290

[22] Filed: Nov. 25, 1987

[51] Int. Cl.[4] ..... G03G 9/12

[52] U.S. Cl. ..... 430/115; 430/119

[58] Field of Search ..... 430/115, 119

[56] References Cited

U.S. PATENT DOCUMENTS 3,259,581 7/1966 Matkan ..... 430/115

4,702,984 10/1987 El-Sayed et al. ..... 430/115

*Primary Examiner*—John L. Goodrow

[57] ABSTRACT

Liquid Electrostatic Developer consisting essentially of

A. nonpolar liquid having a Kauri-butanol value of less than 30, present in major amount, B. at least one thermoplastic resin having average by area particle size of less than 10 μm, C. a charge director compound, D. particles of a blend of wax and at least one metallic soap or inorganic metal salt, e.g., triglyceride wax/-metallic soap or metal salt.

Optionally a colorant is present. The liquid electrostatic developer is useful in copying, e.g., medical hard copies, making proofs, lithographic printing plates, and resists.

68 Claims, No Drawings

MODIFIED LIQUID ELECTROSTATIC DEVELOPER HAVING IMPROVED IMAGE SCRATCH RESISTANCE

DESCRIPTION

1. TECHNICAL FIELD

This invention relates to a liquid electrostatic developer having improved properties. More particularly this invention relates to a liquid electrostatic developer containing particles of a blend of a wax and at least one metallic soap or inorganic metal salt.

2. BACKGROUND ART

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. Useful liquid toners comprise a thermoplastic resin, dispersant nonpolar liquid and charge director. Generally a suitable colorant is present such as a pigment or dye. The colored toner particles are dispersed in the nonpolar liquid which generally has a high-volume resistivity in excess of $10^9$ ohm centimeters, a low dielectric constant below 3.0 and a high vapor pressure. The toner particles are less than 10 μm average by area size. After the latent electrostatic image has been formed, the image is developed by the colored toner particles dispersed in said dispersant nonpolar liquid and the image may be used directly or subsequently be transferred to a carrier sheet.

A problem with liquid developers, and especially when they are used to develop images on smooth films, is that the images are not sufficiently resistant to scratching. Liquid developers containing dispersed wax to improve scratch resistance are described in prior art. However, the images do not have sufficient scratch resistance for the handling and archival storage required of medical images. In addition, it is difficult to obtain stable dispersions of waxes in developers.

It has been found that the above disadvantages can be overcome and improved liquid electrostatic developers prepared by adding particles containing the combination of a wax at least one metallic soap or metal salt.

SUMMARY OF THE INVENTION

In accordance with this invention there is provided a liquid electrostatic developer consisting essentially of A. nonpolar liquid having a Kauri-butanol value of less than 30, present in a major amount, B. at least one thermoplastic resin having an average by area particle size of less than 10 μm, C. a charge director compound, D. particles of a blend of a wax and at least one metallic soap or inorganic metal salt.

In accordance with an embodiment of this invention there is provided a process for preparing liquid electrostatic developer for electrostatic imaging comprising A. dispersing at an elevated temperature in a vessel (1) a thermoplastic resin, and (2) a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, B. cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

C. separating the dispersion of toner particles having an average by area particle size of less than 10 μm from the particulate media, a charge director compound (3) being added to the dispersion during or subsequent to Step A; and D. adding during or subsequent to step (B) a blend (4) of a wax and at least one metallic soap or metal salt.

DETAILED DESCRIPTION OF THE INVENTION

Throughout the specification the below-listed terms have the following meanings:

In the claims appended hereto "consisting essentially of" means the composition of the electrostatic liquid developer does not exclude unspecified components which do not prevent the advantages of the developer from being realized. For example, in addition to the primary components, there can be present additional components, such as a colorant, fine particle size oxides, adjuvant, e.g., polyhydroxy compound, aminoalcohol, polybutylene succinimide, aromatic hydrocarbon, metallic soap, etc.

Charge director means a compound or material that imparts a charge, i.e., positive or negative, to the liquid electrostatic developer.

Metallic soap means a compound wherein the cationic component is a mono- or polyvalent metal component and an acid portion provided by a saturated or unsaturated carboxylic acid of 1 to 100 carbon atoms, preferably 5 to 35 carbon atoms.

Inorganic metal salt means a compound wherein the cationic component of the salt is selected from the group consisting of the metals of the Groups Ia, IIa, IIIa, Ib, IIb, IVb, Vb, VIb, VIIb, and VIII of the periodic table of elements (see CRC Handbook of Chemistry and Physics, 61st Edition, 1980–1981, Periodic Table Of the Elements), and wherein the anionic component of the salt, for example, is selected from the group consisting of halogen, carbonate, acetate, sulfate, borate, nitrate, phosphate, etc.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.9% by weight, preferably 95 to 99.9% by weight, based on the total weight of liquid developer. The total weight of solids in the liquid developer is 0.02 to 15%, preferably 0.1 to 5.0% by weight. The total weight of solids in the liquid developer is based on the resin, including components dispersed therein, and any pigment component present.

Useful thermoplastic resins or polymers (B) include: ethylene vinyl acetate (EVA) copolymers (Elvax® resins, E. I. du Pont de Nemours and Company, Wilmington, DE), copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite® DPD 6169, DPDP 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn® ionomer resin by E. I. du Pont de Nemours and Company, Wilmington, DE, etc., polyester, polyvinyl toluene, polyamide, styrene butadiene copolymers, epoxy resins, acrylic resins, such as a copolymer of acrylic or methacrylic acid (optional but preferred) and at least one alkyl ester of acrylic or methacrylic acid wherein alkyl is 1 to 20 carbon atoms, e.g., methyl acrylate(50 to 90%)/methacrylic acid(0 to 20%)/ethylhexyl acrylate(10 to 50%); and other acrylic resins including Elvacite® Acrylic Resins, E. I. du Pont de Nemours and Company, Wilmington, DE, or blends of the resins. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purpose of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 60 and a melt index of 100 and 500 determined at 190° C., respectively.

In addition, the resins have the following preferred characteristics:

1. Be able to disperse the colorant, e.g., pigment; metallic soap, etc.,
2. Be substantially insoluble in the nonpolar liquid at temperatures below 40° C., so that the resin will not dissolve or solvate in storage,
3. Be able to solvate at temperatures above 50° C.,
4. Be able to be ground to form particles between 0.1 μm and 5 μm, in diameter,
5. Be able to form a particle (average by area) of less than 10 μm, e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm.
6. Be able to fuse at temperatures in excess of 70° C. By solvation in 3. above, the resins forming the toner particles will become swollen, gelatinous or softened.

Suitable charge director compounds or materials (C), which impart charge to the particles and which are generally used in an amount of 0.1 to 10,000 mg/g, preferably 1 to 500 mg/g developer solids, include: positive charge directors, e.g., sodium dioctylsulfosuccinate (manufactured by American Cyanamid Co.), ionic charge directors such as zirconium octoate, copper oleate, iron naphthenate etc., nonionic charge directors such as polyethylene glycol sorbitan stearate, as well as nigrosine and triphenylmethane type dyes; negative charge directors, e.g., lecithin, Basic Calcium Petronate®, Basic Barium Petronate® oil-soluble petroleum sulfonate, manufactured by Sonneborn Division of Witco Chemical Corp., New York, NY, alkyl succinimide manufactured by Chevron Chemical Company of California, etc. Also useful are glyceride type charge directors which may impart a positive or negative charge to the developer depending on the resin, pigment and/or adjuvant used. Suitable glyceride type charge directors are disclosed in Chan, El-Sayed, Trout and Thanawalla U.S. application Ser. No. 125,503 entitled "Glycerides as Charge Directors for Liquid Electrostatic Developers", filed concurrently herewith, the disclosure of which is incorporated herein by reference.

Component (D) of the liquid electrostatic developer in particulate form is a blend of a wax and at least one metallic soap or inorganic metal salt. By blend of a wax with either the metallic soap or inorganic metal salt is meant:

(1) the metallic soap or metal salt is dispersed in the wax which is heated at a temperature sufficient to melt the wax and the dispersion (blend) is mixed for a time sufficient to disperse the metallic soap or metal salt; or (2) the reaction product of a wax, e.g., a triglyceride, and a metal hydroxide, e.g., calcium hydroxide, which produces a glyceride wax and a metallic soap.

Particles can be formed by various methods. Preferably particles are formed when the blend is dispersed with the nonpolar liquid carrier at elevated temperature and the dispersion is cooled to ambient temperature. The particle size of the wax/metallic soap or metal salt blend preferably is larger than the resin particles in the liquid electrostatic developer. The average by area particle size of the blend ranges from 0.5 to 30 μm.

Useful waxes for the blend include: polyolefin waxes, solid paraffin waxes, ester waxes, amide waxes, etc. Examples of these various type waxes without limiting the invention are:

(a) polyolefin waxes which are low molecular weight waxes having a softening point of about 60° C. to about 130° C., e.g., polyalkylene waxes such as those prepared from ethylene, propylene, butene-1, pentene-1, hexene-1, heptene-1, octene-1, nonene-1, decene-1 or the isomer thereof such as 3-methyl-1-butene, 3-methyl-2-pentene, 3-propyl-5-methyl-2-hexene, etc., carnauba wax, olefin copolymers, e.g., ethylene-propylene, ethylene-butene, ethylene-pentene, propylene-butene, propylene-pentene, ethylene-3-methyl-1-butene, ethylene-propylene-butene; ethylene-vinyl acetate, ethylene-vinyl methylether, ethylene-vinyl chloride, ethylene-methyl acrylate, ethylene-methyl methacrylate, ethylene-acrylic acid, propylene-vinyl acetate, propylene-vinyl ethylether, propylene ethyl acrylate, propylene-methacrylic acid, butene-vinyl methylether, pentene-vinyl acetate, hexene-vinyl butylate, ethylene-propylene-vinyl acetate, ethylene-vinyl acetate-vinyl methylether, etc.

(b) paraffin waxes which have a relatively high melting point in the range of about 60° to 130° C., e.g., natural wax, microwax, Fisher-Tropsche wax and the oxidized or saponified products. Examples of such waxes include: Shell 135 Paraffin Wax (Shell Oil Co.), Sazole Wax H1, A1 and A2 (Sazole Marketing Co.), Santite ®A, B and C (Seiko Chemical Co.), 22-Fritetracontanon (Tokyo Kasei Co.), Amble® wax (Hodogaya Chemical Co., Ltd.), etc.

(c) aliphatic acid esters or partial saponification products thereof, e.g., glyceryl tribehenate, glyceryl tripalmitin, glyceryl tristearate; glyceryl tricaprylate, glyceryl tridecanoate, glyceryl heptanoate, glyceryl trilinoleate, glyceryl trinonylate, etc.;

(d) amide waxes which have a melting point in the range of 100° to 180° C., e.g., alkylene bisamide compounds such as:

"Bisamide" (Nitto Chem. Ind. Co., Ltd.),
"Diadd 200 Bis" (Nippon Hydrogen Co., Ltd.),
"Alflow H505" (Nippon Oil and Fats Co., Ltd.),
"Hoechst Wax C" (Hoechst),
"Plastflow" (Nitto Chemical Ind., Co., Ltd.)
"Lubron E" (Nippon Hydrogen Co., Ltd.)
"Amide 6-L and 7-S" (Kawaken Fine Chemical Co.
"Armowax-EBS" (Lion-Armer Co.).

Useful metallic soaps which can be blended with the aforementioned waxes include those wherein the metal is sodium, potassium, barium, calcium, magnesium, strontium, zinc, cadmium, aluminum, gallium, lead, chromium, manganese, iron, nickel, and cobalt, etc. and the acid portion is provided by a saturated or unsaturated carboxylic acid of 1 to 100, preferably 5 to 35 carbon atoms, e.g., caproic acid, octoic (caprylic) acid, capric acid, lauric acid, myristic acid, palmitic acid, stearic acid, oleic acid, linoleic acid, erucic acid, tallitic acid, resinic acid, naphthenic acid, behenic acid, etc. Examples of metallic soaps include: aluminum tristearate, aluminum distearate, sodium, barium, calcium, lead, chromium, copper, magnesium, and zinc stearates; cobalt, iron, manganese, lead and zinc linoleates; aluminum, calcium and cobalt octoates; calcium and cobalt oleates; zinc palmitate; calcium, cobalt, iron, nickel, manganese, lead and zinc naphthenates; calcium, cobalt, manganese, lead and zinc resinsates; calcium and magnesium behenates, etc.

Useful inorganic metal salts which can be blended with the aforementioned waxes include those wherein the cationic component of the salt is selected from the group consisting of the metals of Groups Ia, IIa, IIIa, Ib, IIb, IVb, Vb, VIb, VIIb and VIII, of the periodic table of elements (see CRC Handbook of Chemistry and Physics, 61st Edition, 1980–1981, Periodic Table of the Elements), and wherein the anionic component of said salt is selected from the group consisting of halogen, carbonate, acetate, sulfate, borate, nitrate, phosphate, etc. The cationic component metals, for example, include: sodium, potassium, barium, calcium, magnesium, strontium, aluminum, iron, zinc, lithium, rubidium, cesium, beryllium, titanium, chromium, manganese, cobalt, nickel, copper, silver, tungston, ruthenium, etc. Examples of inorganic metal salts include: sodium chloride, sodium bromide, sodium acetate, potassium chloride, magnesium sulfate, calcium carbonate, cesium chloride, rubidium nitrate, beryllium sulfate, lithium bromide, rubidium acetate, strontium chloride, calcium acetate, aluminum sulfate, sodium borate, sodium phosphate, ruthenium ammonium chloride, manganese chloride, etc.

The blend of a wax and metallic soap can contain 25 to 99% by weight wax, and 1 to 75% by weight metallic soap. The blend of a wax and inorganic metal salt can contain 50 to 99% by weight wax and 1 to 50% by weight metal salt. Preferred ranges are 50 to 90% by weight wax, and 10 to 50% by weight metallic soap; 70 to 99% by weight wax and 1 to 30% by weight metal salt. The wax/metallic soap or metal salt blend can be present in the liquid electrostatic developer in an amount of 0.001 to 5% by weight, preferably 0.02 to 0.2% by weight based on the total weight of developer solids.

As indicated above, an additional component that can be present in the electrostatic liquid developer is a colorant, such as a pigment or dye and combinations thereof, which is preferably present to render the latent image visible, though this need not be done in some applications. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments are Monastral® Blue G (C.I. Pigment Blue 15 C.I. No. 74160), Toluidine Red Y (C.I. Pigment Red 3), Quindo® Magenta (Pigment Red 122), Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1), Monastral ® Blue B (C.I. Pigment Blue 15), Monastral ® Green B (C.I. Pigment Green 7), Pigment Scarlet (C.I. Pigment Red 60), Auric Brown (C.I. Pigment Brown 6), Monastral ® Green G (Pigment Green 7), Carbon Black, Cabot Mogul L (black pigment C.I. No. 77266) and Sterling ® NS N 774 (Pigment Black 7, C.I. No. 77266).

Fine particle size oxides, e.g., silica, alumina, titania, etc.; preferably in the order of 0.5 μm or less can be dispersed into the liquefied resin. These oxides can be used alone or in combination with the colorants. Metal particles can also be added.

Another additional component of the electrostatic liquid developer is an adjuvant which, for example, includes polyhydroxy compound which contains at least 2 hydroxy groups, aminoalcohol, polybutylene succinimide, aromatic hydrocarbon having a Kauributanol value of greater than 30, metallic soap, etc. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycol monohydroxystearate, etc.

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc.

polybutylene/succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc.

metallic soap: aluminum tristearate; aluminum distearate; barium, calcium, lead and zinc stearates; cobalt, manganese, lead and zinc linoleates; aluminum, calcium, and cobalt octoates; calcium and cobalt oleates; zinc palmitate; calcium, cobalt, manganese, lead and zinc naphthenates; calcium, cobalt, manganese, lead and zinc resintates; etc. The metallic soap is dispersed in the thermoplastic resin as described in Trout, U.S. Pat. No. 4,707,429, the disclosure of which is incorporated herein by reference.

The particles in the electrostatic liquid developer have an average by area particle size of less than 10 μm, preferably the average by area particle size is less than 5 μm. The resin particles of the developer may or may not be formed having a plurality of fibers integrally extending therefrom. The term "fibers" as used herein means pigmented toner particles formed with fibers, tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, CA, equipped with particulate media, for dispersing and grinding, Ross double planetary mixer manufactured by Charles Ross and Son, Hauppauge, NY, etc., or a two roll heated mill (no particulate media necessary) are placed the thermoplastic resin, and dispersant polar liquid described above. Generally the resin, dispersant nonpolar liquid and optional colorant are placed in the vessel prior to starting the dispersing step. Optionally the colorant can be added after homogenizing the resin and the dispersant nonpolar liquid. Polar additive can also be present in the vessel, e.g., up to 100% based on the weight of polar additive and dispersant nonpolar liquid. The dispersing step is generally accomplished at elevated temperature, i.e., the temperature of ingredients in the vessel being sufficient to plasticize and liquefy the resin but being below that at which the nonpolar liquid or polar additive, if present, degrades and the resin and/or colorant, if present, decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulates materials, e.g., spherical, cylindrical, etc. taken from the class consisting of stainless steel, carbon steel, alumina, ceramic, zirconium, silica, and sillimanite. Carbon steel particulate media are particularly useful when colorants other than black are used. A typical diameter range for the particulate media is in the range of 0.04 to 0.5 inch (1.0 to ~13 mm).

After dispersing the ingredients in the vessel, with or without a polar additive present until the desired dispersion is achieved, typically 1 to 2 hours with the mixture being fluid, the dispersion is cooled, e.g., in the range of 0° C. to 50° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media; or with stirring to form a viscous mixture and grinding by means of particulate media. Additional liquid may be added at any step during the preparation of the liquid electrostatic developers to facilitate grinding or to dilute the developer to the appropriate % solids needed for toning. Additional liquid means dispersant nonpolar liquid, polar liquid, or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Tone particles of average particle size (by area) of less than 10 μm, as determined by a Horiba CAPA-500 centrifugal particle analyzer described above or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion may be reduced by the addition of additional dispersant nonpolar liquid during or subsequent to the cooling of the dispersion. The dilution is normally conducted to reduce the concentration of toner particles to between 0.02 to 15 percent by weight, preferably 0.1 to 5.0, and more preferably 0.1 to 2 weight percent with respect to the dispersant nonpolar liquid. One or more charge director compounds (C), of the type set out above, can be added to impart a positive or negative charge, as desired. The addition may occur at any time during the process; preferably at the end of the process, e.g., after the particulate media, if used, are removed and the desired concentration of toner particles is achieved. If a diluting dispersant nonpolar liquid is also added, the charge director can be added prior to, concurrently with, or subsequent thereto. The blend of the wax and at least one metallic soap or metal salt is added during or subsequent to the cooling step, preferably subsequent to the cooling step. If an adjuvant compound of a type described above has not been previously added in the preparation of the developer, it can be added prior to or subsequent to the developer being charged.

Another process embodiment for preparing the liquid electrostatic developer comprises (A) dispersing in a thermoplastic resin a colorant and/or adjuvant in the absence of a nonpolar liquid having a Kauri-butanol value of less than 30 to form a mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, to form a dispersion of toner particles in the liquid, (D) separating the particulate media from the dispersion of toner particles having an average by area particle size of less than 10 μm, (E) adding to the dispersion during or subsequent to step (C) a charge director and a blend of at least one metallic soap or metal salt and a wax. Preferably additional nonpolar liquid is added during at least one of steps (C) to (E) of this process. Polar liquid or combinations of polar liquid and nonpolar liquid can also be added.

INDUSTRIAL APPLICABILITY

The liquid electrostatic developer of this invention are useful in copying, particularly in making medical hard copies which are particularly resistant to scratching of the image when compared with copies prepared from prior liquid electrostatic developers. The liquid electrostatic developers are also useful in color proofing, e.g., a reproduction of an image using the standard colors: yellow, cyan, magenta and black; digital color proofing, lithographic printing plates, and resists.

EXAMPLES

The following examples illustrate but do not limit the invention wherein the percentages and parts are by weight.

Syncrowax ®HRS-C is glycerol/calcium behenate which is a saponification product of glycerol and calcium hydroxide, sold by Croda, Inc., New York, NY.

Syncrowax ®HRS is glycerol tribehenate, sold by Croda, Inc., New York, NY.

Amoco 9040 is an alkylhydroxybenzylpolyamine sold as 45% surfactant, 30% aromatic hydrocarbon, and oil having a number average molecular weight of about 1600 to 1800, by Amoco Petroleum Additives Company, Clayton, MO.

Number average molecular weight can be determined by known osmometry techniques.

Weight average molecular weight can be determined by gel permeation chromatography (GPC).

Melt indices can be determined by ASTM D 1238.

Acid No. is milligrams potassium hydroxide required to neutralize 1 gram of polymer.

The average particle sizes by area can be determined by a Horiba CAPA-500 centrifugal particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm.

Images were made in the examples by means of a photoconducting film, e.g., such as are described in Mattor U.S. Pat. No. 3,314,788 and Paulin et al. U.S. Pat. No. 4,248,952, the disclosures of which are incorporated herein by reference, and which has a base support, such as 0.007 (0.18 mm) polyethylene terephthalate, bearing two layers, the outer layer being an organic photoconductive layer, and the inner layer next to the support being an electrically conductive layer such as aluminum, a portion of the outer layer being removed along at least one edge thereof to define a strip of the conductive layer and on the exposed strip a conductive paint was placed so as to permit the conductive layer to be grounded. The photoconducting film used was passed over a 1000 V scorotron at 0.5 inch/second (1.27 cm/second), discharging selectively using a cathode ray tube, and toning with the developer of the samples as described was accomplished, using a developer-filled gap between a 350 V development electrode and the charged film. The images were fused in an oven at 115° C. for 1 minute, and after cooling to room temperature, scratch tested as described below.

Scratch Testing: The fused images were tested for scratching susceptibility using a Hewlett Packard scratch testing device composed of an HP85B computer and an HP7580B plotter and two pens with 0.7 and 0.18 mm diameters, each pen using 10 g, 18 g, 34 g or 66 g weights.

EXAMPLE 1

| INGREDIENTS | Amount (g) |
|---|---|
| Copolymer of ethylene (89%) and methacrylic acid (11%) melt index at 190° C. is 100, acid no. is 66 | 35.00 |
| Uhlich BK 8200. laked Carbon Black. Paul Uhlich & Co., Inc. Hastings-On-Hudson, NY | 1.42 |
| Isopar ® -L, nonpolar liquid having a Kauri-butanol value of 27, Exxon Corporation | 1000.00 |

The ingredients were heated to 100° C. +/−10° C. in a Union Process 1 S attritor, Union Process Company, Akron, OH and milled with 0.1875 inch (4.76 mm) diameter stainless steel balls for two hours and ten minutes. The attritor was cooled to room temperature while the milling was continued and then 700 grams of Isopar ®-L, nonpolar liquid having a Kauri-butanol value of 27, Exxon Corporation, and 45 grams of Amoco 9040 were added. After 3 hours of cold grinding an additional 20 grams of Amoco 9040 were added. After 23 hours of grinding an additional 15 grams of Amoco 9040 were added. Milling was continued for 29.5 hours to obtain toner particles with an average size of 0.42 μm by area. The particulate media were removed and the dispersion of toner particles was then diluted to 0.5 percent solids with additional Isopar ®-L.

Sample 1A was prepared by mixing 10 grams of iron naphthenate solution, solution received as 6% by weight in mineral spirits diluted to 0.6% with Isopar ®-L, Polysciences, Inc., Warrington, PA, with 1500 grams of the above dispersion. Sample 1B was prepared by mixing 10 grams of said iron naphthenate and 150 grams of 1% Syncrowax ®HRS-C in Isopar ®-L with 1500 grams of the above dispersion. Image scratch test results are shown in Table 1 below. Sample 1A produced an image which scratched more easily than Sample 1B.

EXAMPLE 2

| INGREDIENTS | Amount (g) |
|---|---|
| Terpolymer of methyl acrylate (67.3%) methacrylic acid (3.1%), and ethylhexyl acrylate (29.6%), weight average molecular weight of 172,000, acid no. is 13 | 35.0 |
| Nigrosine SSB International Dyestuff Corp., Clifton, NJ | 7.0 |
| Isopar ® -L, nonpolar liquid having a Kauri-butanol value of 27, Exxon Corporation | 125.0 |

The ingredients were heated to 100° C.+/−10° C. in a Union Process 01 attritor, Union Process Company, Akron, OH and milled at a rotor speed of 230 rpm with 0.1875 inch (4.76 mm) diameter stainless steel balls for 1.5 hours. The attritor was cooled to room temperature while the milling was continued and then 80 grams of additional Isopar ®-L, nonpolar liquid were added. After 17.25 hours of cold grinding 10 grams of Amoco 9040 were added. Milling was continued for an additional 1.5 hours to obtain toner particles with an average particle size less than 0.1 μm. The particulate media were removed and the dispersion of toner particles was then diluted to 0.5 percent solids with additional Isopar ®-L. Sample 2A was prepared by mixing 15 grams of a 10% solution of a glyceride charge director, Emphos ®D70-30C, Witco Chemical Corp., New York, NY with 1500 grams of the dispersion. Sample 2B was prepared by mixing 15 grams of a 10% solution of Emphos ®D70-30C and 150 grams of 1% Syncrowax ®HRS-C in Isopar ®-L with 1500 grams of the dispersion.

Image scratch test results are shown in Table 1 below. Developer Sample 2A produced an image which scratched more easily then an image produced from developer Sample 2B.

EXAMPLE 3

Sample 3A was 1500 grams of A. B. Dick Toner (T18), black pigmented, positively charged toner particles in a petroleum distillate, A. B. Dick Corp., Niles, IL. Sample 3B was prepared by mixing 50 grams of 1% Syncrowax ®HRS-C in Isopar ®-G with 1500 grams of the A. B. Dick Toner. Image test results are shown in Table 1 below.

EXAMPLE 4

Toner sample 4A represents the A. B. Dick Toner described in Example 3. Toner sample 4B was prepared by mixing 50 grams of 1% Syncrowax ®HRS in Isopar ®-G with 1500 grams of the A. B. Dick Toner. Toner sample 4C was prepared by mixing 100 grams of 1% Syncrowax ®HRS in Isopar ®-G with 1500 grams of the A. B. Dick Toner. Image scratch test results are shown in Table 1 below. All images scratched easily. The Syncrowax ®HRS did not help scratch resistance.

EXAMPLE 5

Wax/metallic soap particles were prepared as follows: to 60 grams of molten Syncrowax ®HRS were added 30 grams of magnesium behenate, K&K Laboratories, Plainview, NY. The mixture was stirred for 5 hours at 70° F. (21.1° C.) and then cooled to form a solid blend. 2 grams of the wax/metallic soap blend were dissolved in 200 grams of hot Isopar ®-L to form a 1% wax/metallic soap solution. On cooling, the wax/metallic soap precipitated out of solution to form particles with an average size of less than 10 μm.

1500 grams of the A. B. Dick Toner described in Example 3 were mixed with 100 grams of the 1% wax/metallic soap solution. Scratch resistance of the image was superior to the control images described in Example 4. Image scratch test results are shown in Table 1 below.

EXAMPLE 6

Wax/metallic soap particles were prepared as follows: to 60 grams of Syncrowax ®HRS were added 35 grams of barium stearate, K&K Laboratories, Plainview, NY. The mixture was stirred for 5 hours at 70° F. (21.1° C.) and then cooled to form a solid blend. 2 grams of the wax/metallic soap blend were dissolved in 200 grams of hot Isopar ®-L to form a 1% wax/metallic soap solution. On cooling, the wax/metallic soap precipitated out of solution to form particles with an average size of less than 10 μm.

1500 grams of the A. B. Dick Toner described in Example 3 were mixed with 100 grams of the 1% wax/metallic soap solution. Images were made as described in Example 1. Scratch resistance of the image was superior to the control images described in Example 4. Image scratch test results are shown in Table 1 below.

EXAMPLE 7

Wax/metallic soap particles were prepared as follows: to 60 grams of Syncrowax ® were added 100 grams of 6% iron naphthenate in mineral oil, Polysciences. Inc., PA. The mixture was stirred for 7 hours at 70° F. (21.1° C.) and then cooled to form a solid blend. 2 grams of the wax/metallic soap blend were dissolved in 200 grams of hot Isopar ®-L to form a 1% wax/metallic soap solution. On cooling, the wax/metallic soap precipitated out of solution to form particles with an average size of less than 10 μm.

1500 grams of the A. B. Dick Toner described in Example 3 were mixed with 100 grams of the 1% wax/metallic soap solution. Scratch resistance of the image was superior to the control images described in Example 4. Image scratch test results are shown in Table 1 below.

EXAMPLE 8

Wax/metal salt particles were prepared as follows: to 40 grams of Syncrowax ®HRS were added 15 grams of magnesium sulfate, Aldrich Chemical Co., Milwaukee, WI. The mixture was stirred for 1 hour at 70° F. (21.1° C.) and then cooled to form a solid blend. 2 grams of the wax/metal salt blend were dissolved in 200 grams of hot Isopar ®-L to form a 1% wax/metal salt solution. On cooling, the wax/metal salt precipitated out of solution to form particles with an average size of less than 10 μm.

1500 grams of the A. B. Dick Toner described in Example 3 were mixed with 100 grams of the 1% wax/-metal salt solution. Scratch resistance of the image was superior to the control images described in Example 4. Image scratch test results are shown in Table 1 below.

EXAMPLE 9

Wax/metallic soap particles were prepared as follows: to 50 grams of Syncrowax ®HRS were added 20 grams of aluminum tristearate, Witco Chemical Co., New York, NY. The mixture was stirred for 1 hour at 70° F. (21.1° C.) and then cooled to form a solid blend. 2 grams of the wax/metallic soap blend were dissolved in 200 grams of hot Isopar ®-L to form a 1% wax/metallic soap solution. On cooling, the wax/metallic soap precipitated out of solution to form particles with an average size of less than 10 μm.

1500 grams of the A. B. Dick Toner described in Example 3 were mixed with 100 grams of the 1% wax/-metallic soap solution. Scratch resistance of the image was superior to the control images described in Example 4. Image scratch test results are shown in Table 1 below.

EXAMPLE 10

Wax/metallic soap particles were prepared as follows: to 40 grams of Syncrowax ®HRS were added 20 grams of sodium stearate, Witch Chemical Co., New York, NY. The mixture was stirred for 1 hour at 70° F. (21.1° C.) and then cooled to form a solid blend. 2 grams of the wax/metallic soap blend were dissolved in 200 grams of hot Isopar ®-L to form a 1% wax/metallic soap solution. On cooling, the wax/metallic soap precipitated out of solution to form particles with an average size of less than 10 μm.

1500 grams of the A. B. Dick Toner described in Example 3 were mixed with 100 grams of the 1% wax/-metallic soap solution. Scratch resistance of the image was superior to the control images described in Example 4. Image scratch test results are shown in Table 1 below.

EXAMPLE 11

Wax/metallic soap particles were prepared as follows: to 50 grams of Syncrowax ®HRS were added 20 grams of zinc stearate, Witco Chemical Co., New York, NY. The mixture was stirred for 1 hour at 70° F. (21.1° C.) and then cooled to form a solid blend. 2 grams of the wax/metallic soap blend were dissolved in 200 grams of hot Isopar ®-L to form a 1% wax/metallic soap solution. On cooling, the wax/metallic soap precipitated out of solution to form particles with an average size of less than 10 μm.

1500 grams of the A. B. Dick Toner described in Example 3 were mixed with 100 grams of the 1% wax/-metallic soap solution. Scratch resistance of the image was superior to the control images described in Example 4. Image scratch test results are shown in Table 1 below.

EXAMPLE 12

A: Tripalmitin Wax

Wax preparation: 2 grams of the tripalmitin wax, K&K Laboratories, Plainview, NY, were dissolved in 200 grams of hot Isopar ®-L to form a 1% wax solution. On cooling, the wax precipitated out of solution to form particles with an average size of less than 10 μm.

B: Tripalmitin Wax and Magnesium Stearate

Wax/metallic soap preparation: to 5 grams of tripalmitin wax described in paragraph A above were added 2 grams of magnesium stearate, Witco Chemical Co., New York, NY. The mixture was stirred for 1 hour at 70° F. (21.1° C.) and then cooled to form a solid blend. 2 grams of the wax blend were dissolved in 200 grams of hot Isopar ®-L to form a 1% wax/metallic soap solution. On cooling, the wax/metallic soap precipitated out of solution to form particles with an average size of less than 10 μm.

Evaluation: 1500 grams of the A. B. Dick Toner described in Example 3 were mixed with 100 grams of either the 1% tripalmitin wax solution, Sample 12A (control) or 1% of the tripalmitin/magnesium stearate solution, Sample 12B. Scratch resistance of the wax/-metallic soap image 12B was superior to the control image 12A described in this example. Image scratch test results are shown in Table 1 below.

EXAMPLE 13

A: Polyethylene

Wax preparation: 2 grams of the A. C. Polyethylene Wax, Allied Signal Corp., Morristown, NJ were dissolved in 200 grams of hot Isopar ®-L to form a 1% wax solution. On cooling, the wax precipitated out of solution to form particles with an average size of less than 10 μm.

B: Polyethylene Wax and Magnesium Stearate

Wax/metallic soap preparation: to 50 grams of A. C. Polyethylene Wax described in paragraph A above are added 15 grams of magnesium stearate, Witco Chemical Co., New York, NY. The mixture was stirred for 1 hour at 70° F. (21.1° C.) and then cooled to form a solid blend. 2 grams of the wax blend were dissolved in 200 grams of hot Isopar ®-L to form a 1% wax/metallic soap solution. On cooling, the wax/metallic soap precipitated out of solution to form particles with an average size of less than 10 μm.

Evaluation: 1500 grams of the A. B. Dick Toner described in Example 3 were mixed with 100 grams of either the 1% A. C. Polyethylene Wax solution, Sample 13A (control) or 1% of the A. C. Polyethylene/magnesium stearate solution, Sample 13B. Scratch resistance of the wax/metallic soap image 13B was superior to control image 13A of this example. Image scratch test results are shown in Table 1 below.

TABLE 1

| | PEN LINES | | | | | | | |
|---|---|---|---|---|---|---|---|---|
| SAMPLE | 1 | 2 | 3 | 4 | 5 | 6 | 7 | 8 |
| 1A (control) | A | A | A | A | A | A | A | A |
| 1B | A | S | S | S | S | S | S | S |
| 2A (control) | P | P | S | S | N | N | N | N |
| 2B | S | S | S | S | N | N | N | N |
| 3A (control) | A | A | A | S | N | N | N | N |
| 3B | S | S | S | S | N | N | N | N |
| 4A (control) | A | A | A | A | N | N | N | N |

TABLE 1-continued

| | | | | | | | | |
|---|---|---|---|---|---|---|---|---|
| 4B (control) | A | A | A | S | S | S | N | N |
| 4C (control) | A | A | A | A | N | N | N | N |
| 5 | P | N | N | N | N | N | N | N |
| 6 | N | N | N | N | N | N | N | N |
| 7 | P | P | N | N | N | N | N | N |
| 8 | A | A | N | N | N | N | N | N |
| 9 | A | A | N | N | N | N | N | N |
| 10 | A | N | N | N | N | N | N | N |
| 11 | P | N | N | N | N | N | N | N |
| 12A (control) | A | S | S | S | N | N | N | N |
| 12B | N | N | N | N | N | N | N | N |
| 13A (control) | S | S | S | N | N | N | N | N |
| 13B | N | N | N | N | N | N | N | N |
| | Pen Pressure ($g/mm^2$) | | | | | | | |
| | 2037 | 1045 | 556 | 309 | 135 | 69 | 37 | 20 |

N means image was not affected.
S means image surface only scratched.
P means partially abraded.
A means abraded

I claim:

1. A liquid electrostatic developer consisting essentially of

A. nonpolar liquid having a Kauri-butanol value of less than 30, percent in a major amount, B. at least one thermoplastic resin having an average by area particle size of less than 10 μm, C. a charge director compound, D. particles of a blend of a wax and at least one metallic soap or inorganic metal salt present in an amount of 0.001 to 5% by weight based on the total weight of developer solids.

2. A liquid electrostatic developer according to claim 1 wherein component D is the blend of at least one metallic soap and wax.

3. A liquid electrostatic developer according to claim 2 wherein component D is at least one metallic soap dispersed in the wax.

4. A liquid electrostatic developer according to claim 2 wherein component D is the reaction product of a triglyceride wax and a metal hydroxide.

5. A liquid electrostatic developer according to claim 4 wherein the metal hydroxide is calcium hydroxide.

6. A liquid electrostatic developer according to claim 1 wherein component D is the blend of at least one metal salt and wax.

7. A liquid electrostatic developer according to claim 6 wherein component D is at least one metal salt dispersed in the wax.

8. A liquid electrostatic developer according to claim 1 wherein the particles of component D are larger than those of the thermoplastic resin.

9. A liquid electrostatic developer according to claim 1 wherein the metallic soap is a metal salt of a saturated or unsaturated carboxylic acid of 1 to 100 carbon atoms.

10. A liquid electrostatic developer according to claim 1 wherein the metal salt is a compound wherein the cationic component of the salt is selected from the group consisting of the metals of Groups Ia, IIa, IIIa, Ib, IIb, IVb, Vb, VIb, VIIb and VIII of the period table of elements, and wherein the anionic component of the salt is selected from the group consisting of halogen, carbonate, acetate, sulfate, borate, nitrate and phosphate.

11. A liquid electrostatic developer according to claim 1 wherein the wax is selected from the group consisting of olefin polymers, solid paraffin wax, ester wax and amide wax.

12. A liquid electrostatic developer according to claim 11 wherein the wax is a triglyceride wax.

13. A liquid electrostatic developer according to claim 1 wherein component D is a blend of 1 to 75% by weight of metallic soap and 25 to 99% by weight of wax or 1 to 50% by weight of metal salt and 50 to 99% by weight of wax.

14. A liquid electrostatic developer according to claim 1 wherein component A is present in 85 to 99.98% by weight, component B is present in 0.02 to 15% by weight, component C is present in an amount of 0.1 to 10,000 mg/g developer solids, and component D is present in 0.001 to 5% by weight based on the total weight of developer solids, the total weight of developer solids is 0.02 to 15% by weight.

15. A liquid electrostatic developer according to claim 1 containing up to about 60% by weight of a colorant based on the total weight of developer solids.

16. A liquid electrostatic developer according to claim 15 wherein the colorant is a pigment.

17. A liquid electrostatic developer according to claim 15 wherein the colorant is a dye.

18. A liquid electrostatic developer according to claim 1 wherein the thermoplastic resin is a copolymer of ethylene and an α,β-ethylenically unsaturated ester selected from the group consisting of acrylic acid and methacrylic acid.

19. A liquid electrostatic developer according to claim 15 wherein the thermoplastic resin is a copolymer of ethylene (89%) methacrylic acid (11%) having a melt index at 190° C. of 100.

20. A liquid electrostatic developer according to claim 18 wherein the thermoplastic resin is a copolymer of ethylene (89%) methacrylic acid (11%) having a melt index at 190° C. of 100.

21. A liquid electrostatic developer according to claim 1 wherein the thermoplastic resin is a copolymer of acrylic or methacrylic acid and at least one alkyl ester of acrylic or methacrylic acid wherein alkyl is 1 to 20 carbon atoms.

22. A liquid electrostatic developer according to claim 1 wherein the thermoplastic resin is a copolymer of methyl acrylate 50 to 90% by weight/methacrylic acid 0 to 20% by weight/ethylhexyl acrylate 10 to 50% by weight.

23. A liquid electrostatic developer according to claim 1 wherein the thermoplastic resin particles have an average by area particle size of less than 5 μm.

24. A liquid electrostatic developer according to claim 1 wherein the charge director is iron naphthenate.

25. A liquid electrostatic developer according to claim 1 wherein the charge director is oil-soluble petroleum sulfonate.

26. A liquid electrostatic developer according to claim 4 wherein component D is glycerol/calcium behenate.

27. A liquid electrostatic developer according to claim 3 wherein component D is the molten blend of a triglyceride wax and magnesium behenate.

28. A liquid electrostatic developer according to claim 3 wherein component D is the molten blend of a triglyceride wax and barium stearate.

29. A liquid electrostatic developer according to claim 3 wherein component D is the molten blend of a triglyceride wax and iron naphthenate.

30. A liquid electrostatic developer according to claim 3 wherein component D is the molten blend of a triglyceride wax and aluminum tristearate.

31. A liquid electrostatic developer according to claim 3 wherein component D is the molten blend of a triglyceride wax and sodium stearate.

32. A liquid electrostatic developer according to claim 11 wherein component D is a molten blend of a polyethylene wax and metallic soap.

33. A liquid electrostatic developer according to claim 7 wherein component D is a molten blend of a triglyceride wax and a metal salt.

34. A liquid electrostatic developer according to claim 33 wherein the melt salt is magnesium sulfate.

35. A process for preparing liquid electrostatic developer for electrostatic imaging comprising A. dispersing at an elevated temperature in a vessel (1) a thermoplastic resin, and (2) a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, B. cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

C. separating the dispersion of toner particles having an average by area particle size of less than 10 μm from the particulate media, a charge director (3) being added to the dispersion during or subsequent to step A; and D. adding during or subsequent to step (B) at blend (4) of a wax and at least one metallic soap or metal salt present in an amount of 0.001 to 5% by weight based on the total weight of developer solids.

36. A process according to claim 35 wherein additional liquid is added during or subsequent to step (B).

37. A process according to claim 36 wherein the additional liquid is selected from the group consisting of nonpolar liquid, polar liquid and combinations thereof.

38. A process according to claim 37 wherein the additional liquid is nonpolar liquid.

39. A process according to claim 37 wherein the additional nonpolar liquid reduces the concentration of resin particles to between 0.02 and 15% by weight with respect to the liquid.

40. A process according to claim 35 wherein cooling the dispersion is accomplished while grinding by means of particulate media to prevent the formation of a gel or solid mass.

41. A process according to claim 35 wherein cooling the dispersion is accomplished without stirring to form a gel or solid mass, followed by shredding the gel or solid mass and grinding by means of particulate media.

42. A process according to claim 35 wherein cooling the dispersion is accomplished with stirring to form a viscous mixture and grinding by means of particulate media.

43. A process according to claim 35 wherein component (4) is a blend of at least one metallic soap and wax.

44. A process according to claim 43 wherein component (4) is at least one metallic soap dispersed in the wax.

45. A process according to claim 43 wherein component (4) is a reaction product of a triglyceride wax and a metal hydroxide.

46. A process according to claim 45 wherein the metal hydroxide is calcium hydroxide.

47. A process according to claim 35 wherein component (4) is the blend of at least one metal salt and wax.

48. A process according to claim 47 wherein component (4) is at least one metal salt dispersed in the wax.

49. A process according to claim 35 wherein the particles of component (4) are larger than those of the thermoplastic resin (1).

50. A process according to claim 35 wherein up to about 60% by weight of a colorant based on the total weight of developer solids is added in step (A).

51. A process according to claim 50 wherein the colorant is a pigment.

52. A process according to claim 35 wherein the thermoplastic resin (1) is a copolymer of ethylene and an $\alpha,\beta$-ethylenically unsaturated ester selected from the group consisting of acrylic acid and methacrylic acid.

53. A process according to claim 35 wherein the thermoplastic resin is a copolymer of ethylene (89%)/methacrylic acid (11%) having a melt index at 190° C. of 100.

54. A process according to claim 35 wherein the thermoplastic resin is a copolymer of acrylic or methacrylic acid and at least one alkyl ester of acrylic or methacrylic acid wherein alkyl is 1 to 20 carbon atoms.

55. A process according to claim 35 wherein the thermoplastic resin is a copolymer of methyl acrylate 50 to 90% by weight/methacrylic acid 0 to 20% by weight/ethylhexyl acrylate 10 to 50% by weight.

56. A process according to claim 35 wherein the wax is selected from the group consisting of olefin polymers, solid paraffin wax, ester wax, and amide wax.

57. A process according to claim 56 wherein the wax is triglyceride wax.

58. A process according to claim 35 wherein component (4) is a blend of 1 to 75% by weight of metallic soap and 25 to 99% by weight of wax or 1 to 50% by weight of metal salt and 50 to 99% by weight of wax.

59. A process according to claim 35 wherein the charge director is iron naphthenate.

60. A process according to claim 35 wherein the charge director is oil-soluble petroleum sulfonate.

61. A process according to claim 56 wherein component (4) is a molten blend of a polyethylene wax and metallic soap.

62. A process according to claim 35 wherein component (4) is a molten blend of a triglyceride wax and metallic soap.

63. A process according to claim 62 wherein the metallic soap is magnesium stearate.

64. A process according to claim 35 wherein component (4) is a molten blend of a triglyceride wax and metal salt.

65. A process according to claim 64 wherein the metal salt is magnesium sulfate.

66. A process for preparing liquid electrostatic developer comprising

A. dispersing in a thermoplastic resin a colorant and/or adjuvant in the absence of a nonpolar liquid having a Kauri-butanol value of less than 30 to form a mass, B. shredding the solid mass, C. grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, to form a dispersion of toner particles in the liquid, D. separating the particulate media from the dispersion of toner particles having an average by area particle size of less than 10 μm, E. adding to the dispersion during or subsequent to step (C) a charge director and a blend of at least one metallic soap or metal salt and a wax persent in an amount of 0.001 to 5% by weight based on the total weight of developer solids.

67. A process according to claim 66 wherein additional nonpolar liquid, polar liquid or combination thereof is added during at least one of steps (C) to (E).

68. A process according to claim 67 wherein the additional liquid is a polar liquid.

* * * * *